US010335616B2

(12) United States Patent
Ogura

(10) Patent No.: US 10,335,616 B2
(45) Date of Patent: Jul. 2, 2019

(54) ASCENDER

(71) Applicant: KENTECH SYSTEMS LIMITED, Saitama (JP)

(72) Inventor: Kenji Ogura, Saitama (JP)

(73) Assignee: KENTECH SYSTEMS LIMITED, Saitama (JP)

( * ) Notice: Subject to any disclaimer, the term of this patent is extended or adjusted under 35 U.S.C. 154(b) by 0 days.

(21) Appl. No.: 15/571,928

(22) PCT Filed: Mar. 9, 2017

(86) PCT No.: PCT/JP2017/009629
§ 371 (c)(1),
(2) Date: Nov. 6, 2017

(87) PCT Pub. No.: WO2017/155076
PCT Pub. Date: Sep. 14, 2017

(65) Prior Publication Data

US 2018/0147421 A1 May 31, 2018

(30) Foreign Application Priority Data

Mar. 9, 2016 (JP) ..... 2016-046372

(51) Int. Cl.
*A62B 1/06* (2006.01)
*B66D 1/74* (2006.01)

(52) U.S. Cl.
CPC ..... *A62B 1/06* (2013.01); *B66D 1/7489* (2013.01)

(58) Field of Classification Search
None
See application file for complete search history.

(56) References Cited

U.S. PATENT DOCUMENTS 3,375,725 A * 4/1968 Mathison ..... F16H 55/38 474/153
4,437,546 A * 3/1984 Marinoff ..... A62B 1/12 182/233

(Continued)

FOREIGN PATENT DOCUMENTS

JP 49-55599 U1 5/1974
JP 53-75997 U1 6/1978

(Continued)

OTHER PUBLICATIONS

"Circular." Merriam-Webster.com. Merriam-Webster, n.d. Web. Nov. 16, 2018. (Year: 2018).*

(Continued)

*Primary Examiner* — Katherine W Mitchell
*Assistant Examiner* — Candace L Bradford
(74) *Attorney, Agent, or Firm* — Sughrue Mion, PLLC

(57) ABSTRACT

An ascender includes a pulley, an input shaft, a support member, a transmission mechanism, a rope guide, a cam, an energizing member, an operating member, and a closing member. A rope is removably wound on the pulley. An output shaft of a rotary electric tool is removably connected to the input shaft. The transmission mechanism transmit a rotational force of the input shaft to the pulley. The cam moves toward the pulley to bite into the rope so as to prevent a movement of the rope when the rope is going to move in a descending direction. The cam moves away from the pulley to allow the movement of the rope when the rope is going to move in an ascending direction.

4 Claims, 13 Drawing Sheets

(56) References Cited

U.S. PATENT DOCUMENTS

| | | | | | |
|---|---|---|---|---|---|
| 5,360,083 | A * | 11/1994 | Hede | A62B 1/14 | 182/192 |
| 5,664,640 | A * | 9/1997 | Smith | A62B 1/14 | 182/193 |
| 6,705,597 | B1 * | 3/2004 | Reilly | B60P 7/0846 | 254/223 |
| 7,357,612 | B1 * | 4/2008 | Paul | B60P 7/0853 | 279/144 |
| 7,410,336 | B2 * | 8/2008 | Parks | B60P 7/0846 | 279/144 |
| 7,455,257 | B1 * | 11/2008 | Kaleta | B63C 11/02 | 242/397.3 |
| D775,448 | S * | 12/2016 | Fretz | D34/33 | |
| 2007/0194290 | A1 * | 8/2007 | Fofonoff | B66D 1/7415 | 254/325 |
| 2011/0079967 | A1 * | 4/2011 | Presley | B25F 3/00 | 279/145 |
| 2013/0056695 | A1 * | 3/2013 | Cazzaro | A62B 1/14 | 254/371 |

FOREIGN PATENT DOCUMENTS

| | | | |
|---|---|---|---|
| JP | 55-173347 | U1 | 12/1980 |
| JP | 7-551 | A | 1/1995 |
| JP | 2005-211254 | A | 8/2005 |
| JP | 2007-111454 | A | 5/2007 |
| JP | 2015-204989 | A | 11/2015 |
| WO | 2011/141747 | A2 | 11/2011 |
| WO | 2015/155082 | A1 | 10/2015 |

OTHER PUBLICATIONS

International Search Report dated May 16, 2017, by the International Searching Authority in counterpart International Application No. PCT/JP2017/009629 (PCT/ISA/210).

Written Opinion dated May 16, 2017, by the International Searching Authority in counterpart International Application No. PCT/JP2017/009629 (PCT/ISA/237).

Communication dated Dec. 3, 2018, issued by the European Patent Office in counterpart European Patent Application No. 17763416.9.

* cited by examiner

1

1

1

ASCENDER

TECHNICAL FIELD

The invention relates to an ascender, particularly, an ascender which is capable of ascending by applying driving power to a rope.

BACKGROUND ART

A rope access technology is beginning to spread in which an operator accesses a high place, such as a bridge and a high-rise building where it is difficult to construct a scaffold from the ground, by using a rope and performs an operation such as maintenance and inspection. In the rope access technology, basically, the operator descends from the highest point and accesses an operation site and, after operation, ascends to return to the highest point. An access rope is suspended from a support point secured at the highest point. The operator wearing a harness connects a descender engaged with the access rope to the harness by a carabiner-equipped rope sling. The operator descends gradually while operating the descender, and accesses the operation site. When returning, the operator connects an ascender engaged with the access rope to the harness by the carabiner-equipped rope sling, and ascends gradually while operating the ascender, thereby returning to the support point.

According to the conventional ascender, since the operator is required to ascend by human power, the operator is required a lot of labor.

PRIOR ART DOCUMENT

Patent Document

Patent Document 1: JP-A-07-000551

SUMMARY OF THE INVENTION

Problems that the Invention is to Solve

The invention is made in view of the above problems of the conventional technology and it has an object to provide an ascender capable of ascending without using human power.

Means for Solving the Problems

According to the invention, an ascender includes a pulley capable of removably winding a rope thereon; an input shaft capable of removably connecting an output shaft of a rotary electric tool thereto; a support member capable of supporting the pulley and input shaft rotatably, and including an open part capable of winding a rope on the pulley; a transmission mechanism interposed between the input shaft and pulley for transmitting the rotation force of the input shaft to the pulley; a guide provided on the support member for guiding an entrance passage and an exit passage for the rope wound on the pulley; a cam pivotally supported on the support member so as to move freely toward and away from the pulley, the cam being configured such that, when the rope is going to move in the descending direction, it moves toward the pulley to bite into the rope wound on the pulley to thereby prevent the movement of the rope, and when the rope is going to move in the ascending direction, it moves away from the pulley to allow the movement of the rope; an energizing member for energizing the cam in a direction to move toward the pulley; an operating member for moving the cam away from the pulley; and, a movable closing member pivotally supported on a support shaft with a carabiner hanging hole mounted on the support member for opening and closing the open part.

For example, an ascender according to the invention includes a large number of teeth formed in a rope contact surface of the cam and capable of sticking to a surface of the rope when the rope is going to move in the descending direction.

For example, an ascender according to the invention includes a locking device for locking the cam to a position spaced from the pulley and unlocking the locked cam.

For example, in an ascender according to the invention, the rotary electric tool is rechargeable.

Advantages of the Invention

Since an ascent with a rope is enabled by using a rotary electric tool as a drive source, an ascending labor of an operator can be reduced outstandingly. Since a normal tool to be carried for operation can be used as the rotary electric tool, the operator does not need labor or burden to prepare and carry a special drive source. When the rotary electric tool is rechargeable, there is eliminated the trouble to route a power cord.

MODE FOR CARRYING OUT THE INVENTION

The best mode for carrying out the invention is described below with reference to embodiments thereof.

Embodiment 1

Figure 1:
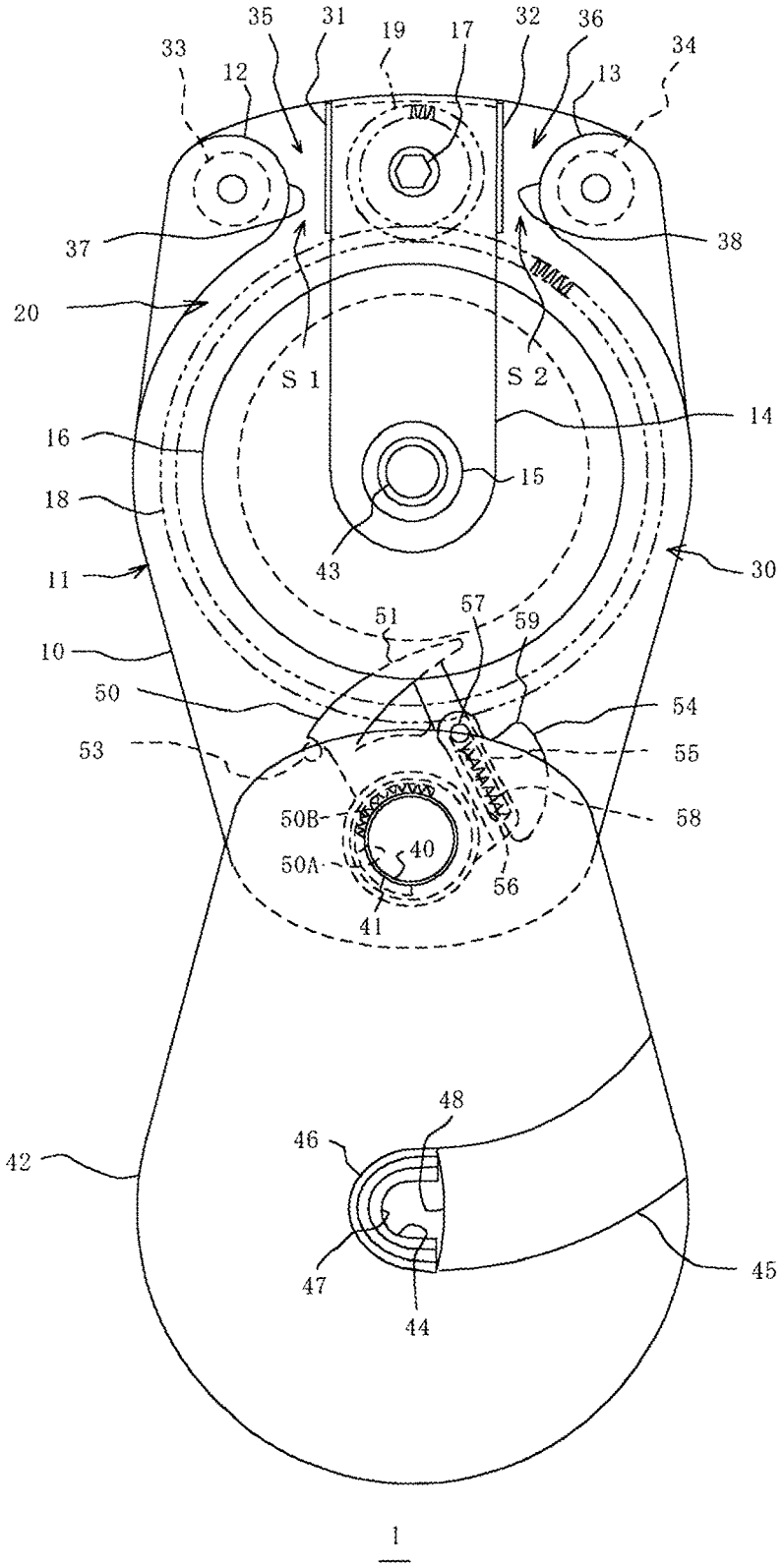
FIG. 1 is a front view of an ascender according to an embodiment of the invention, showing a state where its front surface is opened (Embodiment 1).
Figure 2:
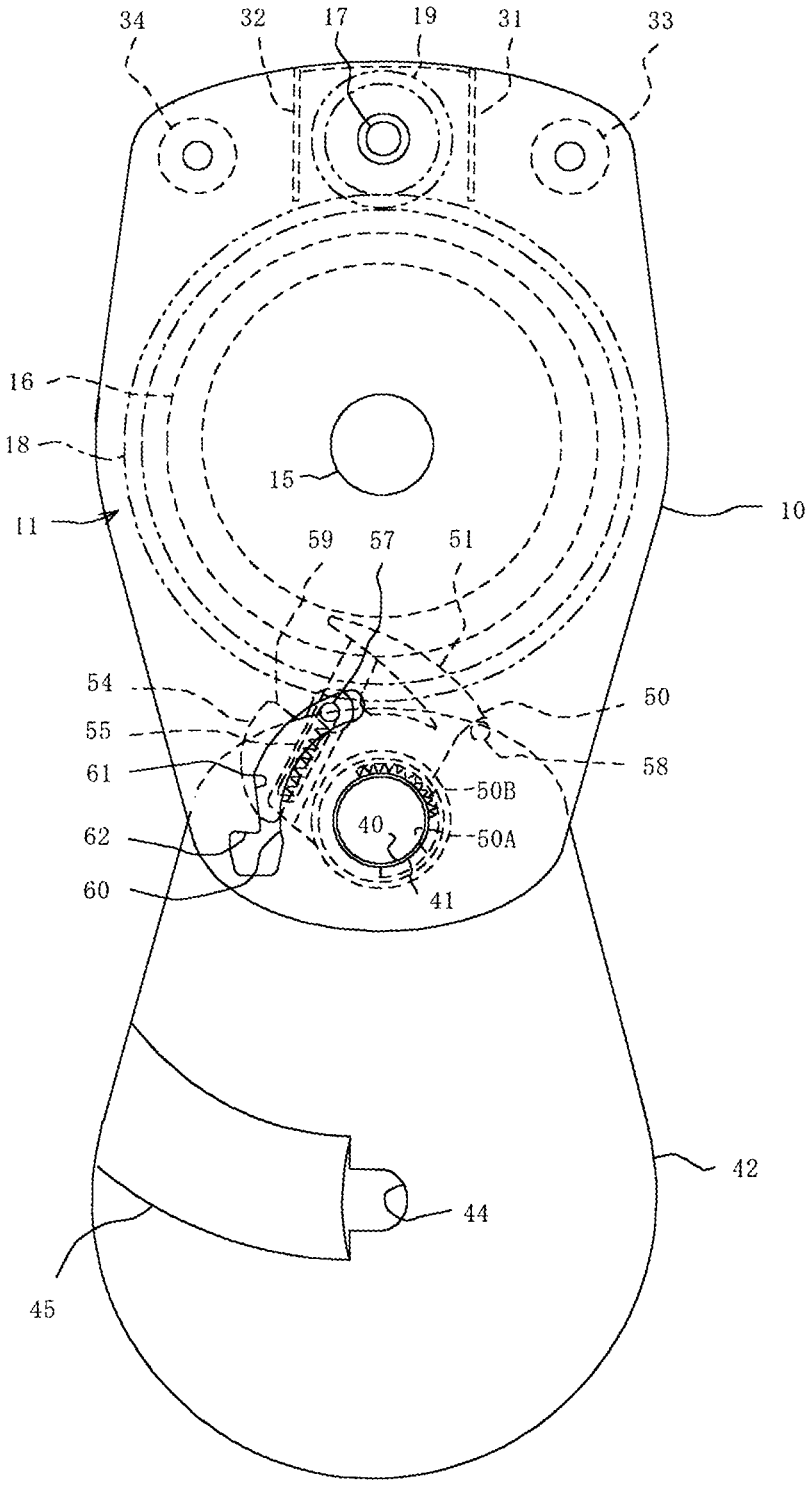
FIG. 2 is a back view of FIG. 1.
Figure 3:
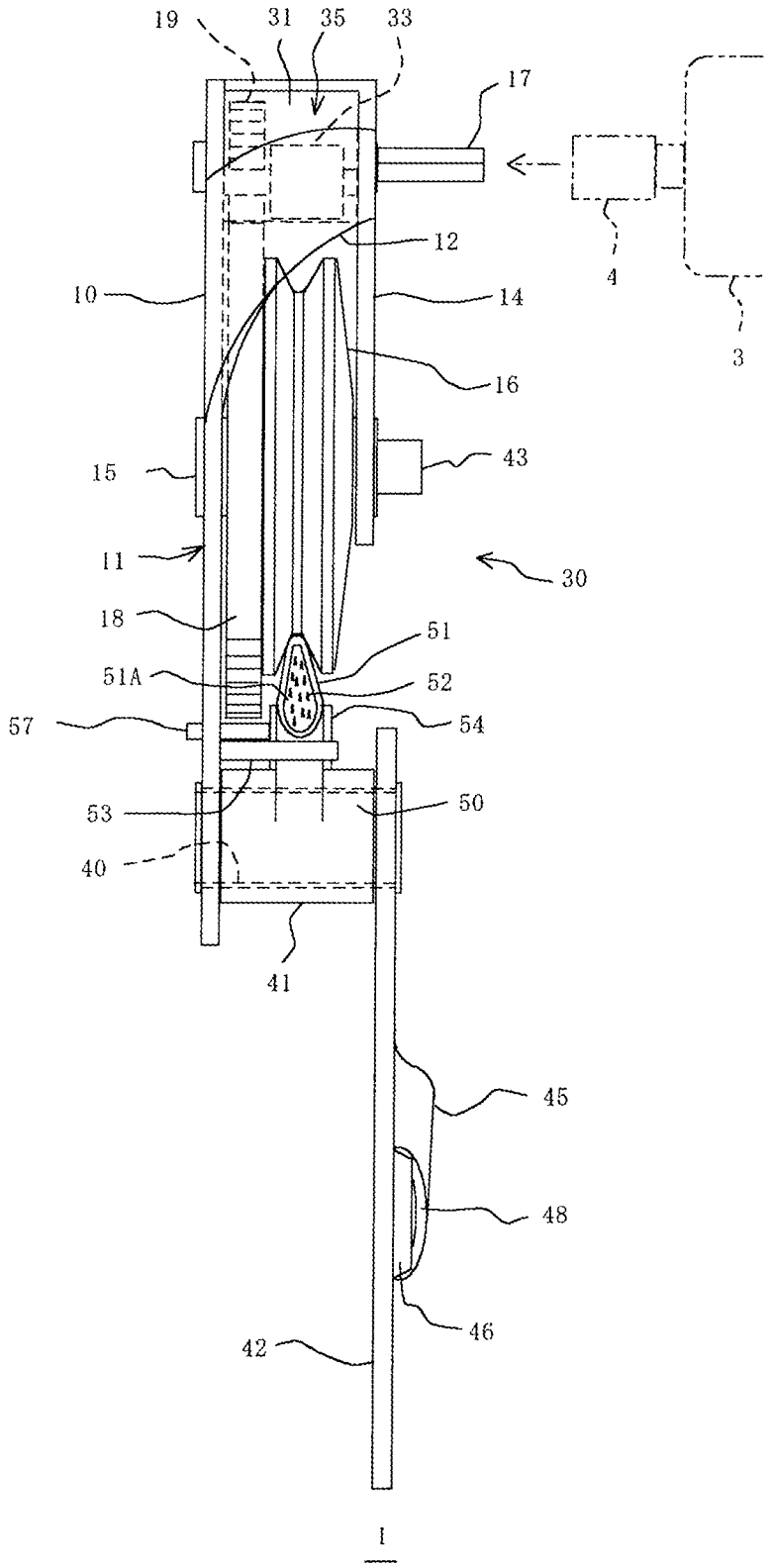
FIG. 3 is a left side view of FIG. 1.
Figure 4:
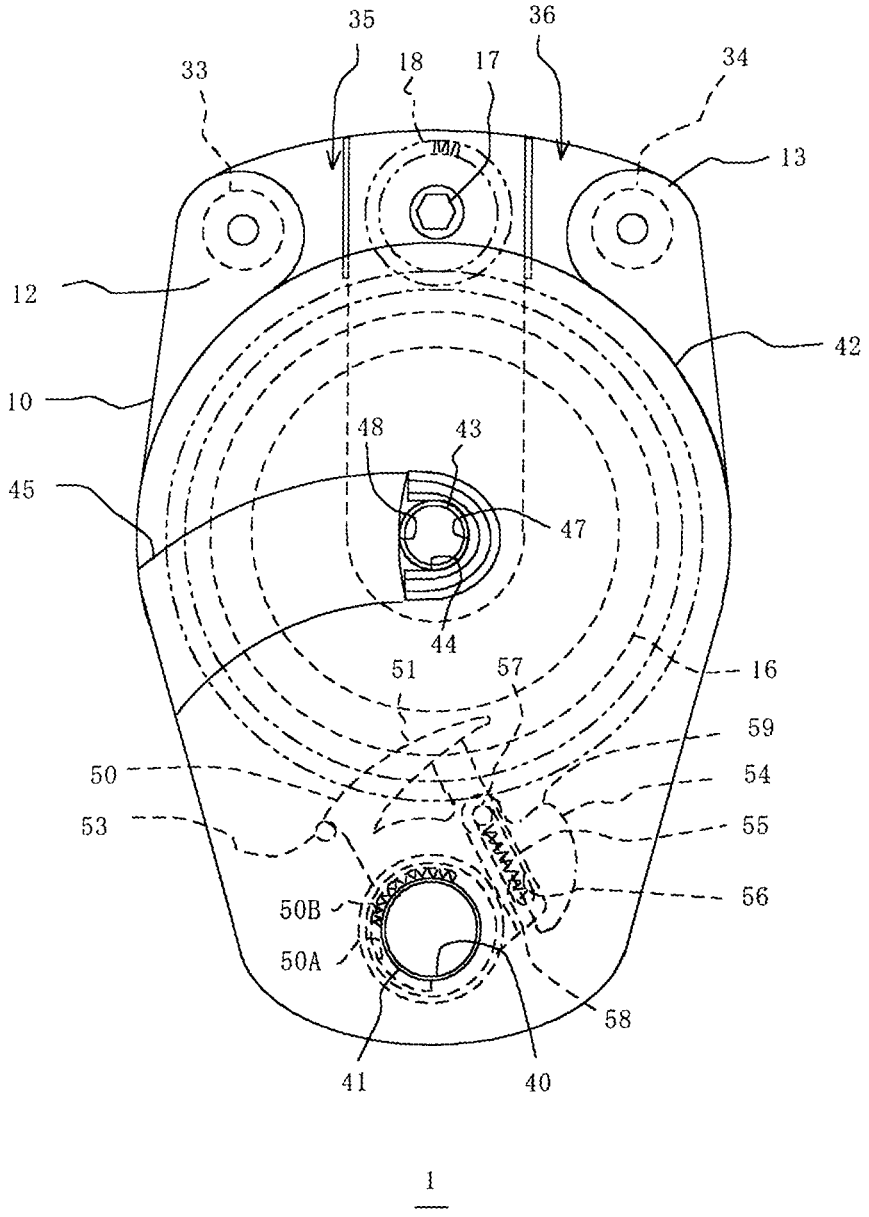
FIG. 4 is a front view of the ascender of FIG. 1, showing a state where its front surface is closed.
Figure 5A:
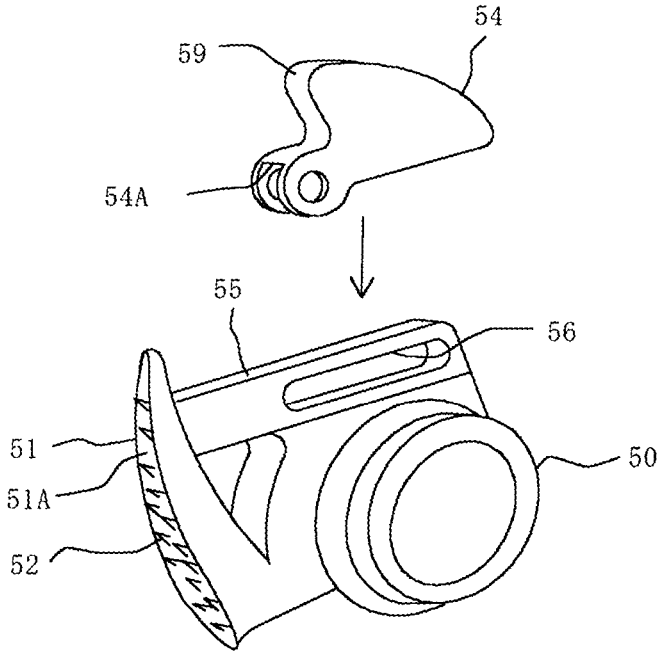
FIG. 5(*a*) and FIG. 5(*b*) are assembled views of a cam shown in FIG. 1, FIG. 5(*a*) shows a state to mount an operation member onto a slide guide part, and FIG. 5(*b*) shows a state in which, with a pin fitted into a long hole of the slide guide part, the operation member is slidable along the slide guide part.
Figure 5B:
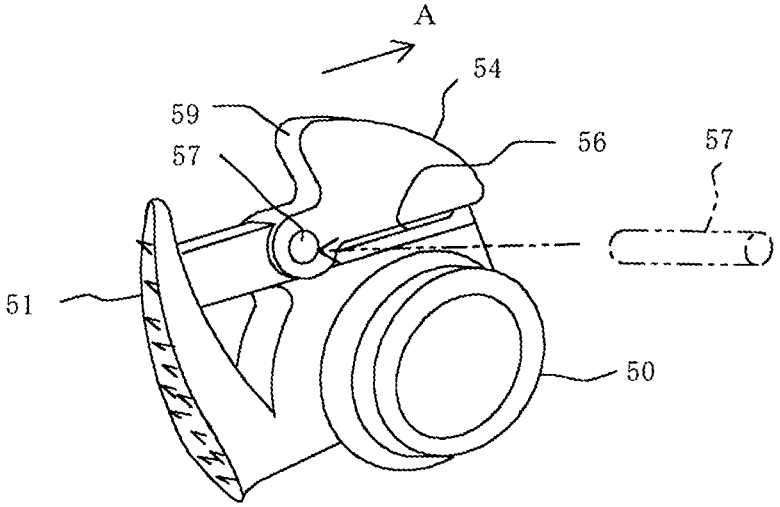

FIG. 1 is a front view of an ascender according to an embodiment of the invention, showing a state where its front surface is opened. FIG. 2 is a back view of the ascender 1 of FIG. 1. FIG. 3 is a left side view of the ascender 1 of FIG. 1. FIG. 4 is a front view of the ascender of FIG. 1, showing a state where its front surface is closed. FIG. 5 is an assembly view of a cam shown in FIG. 1.

Figure 10:
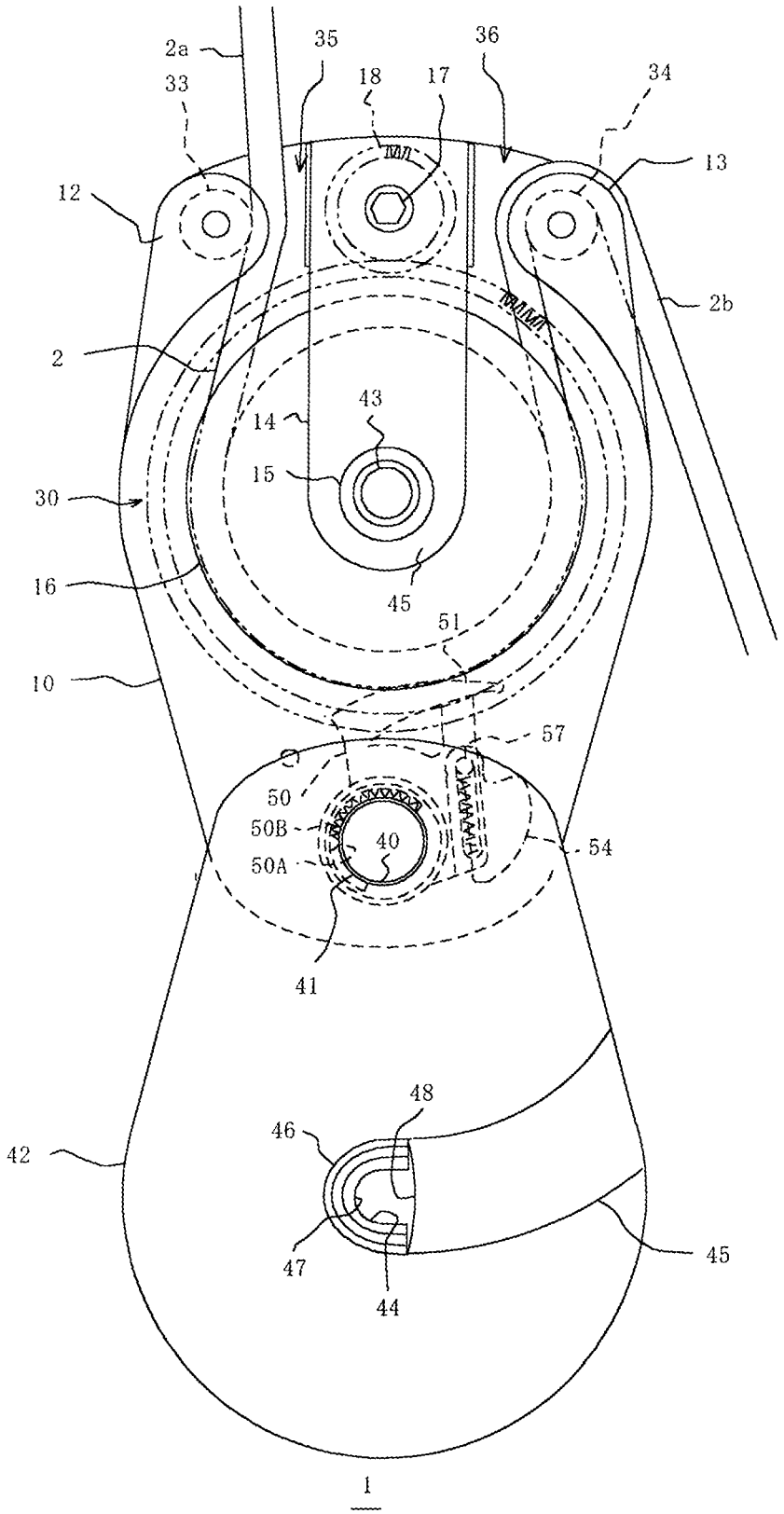
FIG. 10 is an explanatory view of a method for using the ascender of FIG. 1.

In these drawings, reference numeral 1 designates an ascender. By obtaining driving power from a rechargeable electric screwdriver carried by an operator, an ascending with a rope (see reference numeral 2 shown in FIG. 10) is possible. The ascender 1 includes a fixed plate 10 having vertically long substantially hexagonal shape on a back face side of the ascender 1, and the fixed plate 10 serving as a support member. The fixed plate 10 is structured such that both sides of the upper end of its back part 11 are curved toward its front surface side. The fixed plate 10 includes arm parts 12 and 13 respectively arranged at a certain distance from the back part 11 so as to cover the left and right upper corner portions on the front surface side of the fixed plate 10. The fixed plate 10 includes a front side support part 14 bent in an L-like shape from the central portion of the upper end of the back part 11 and extended in parallel to and at a certain distance from the back part 11 to the vicinity of the center of the fixed plate 10. A support shaft 15 is fixed between the center of the back part 11 and the lower end of the front side support part 14 of the fixed plate 10. A pulley 16 is rotatably supported on the support shaft 15. The pulley 16 has a function to move a rope 2 to be removably wound thereon in the peripheral direction.

Between the center of the upper end of the back part 11 and the upper end of the front side support part 14 of the fixed plate 10, an input shaft 17 is supported rotatably and in parallel to the support shaft 15, while the input shaft 17 is configured such that an output shaft of a rechargeable electric screwdriver (see reference numerals 3 and 4 shown in FIG. 3) can be removably connected to the input shaft 17 and rotation power is input to the input shaft 17 from the electric screwdriver 3. The input shaft 17 has a hexagonal shaft shape and is capable of removably mounting thereon a chuck part 4 serving as the output shaft of the electric screwdriver 3. The input shaft 17 is arranged radially outward from the outer periphery of the pulley 16. A gear 18 having a larger diameter than the outside diameter of the pulley 16 is coaxially integrated with the pulley 16 and rotates integrally with the pulley 16. (The outside diameter of the gear 18 may be equal to or smaller than the outside diameter of the pulley 16). A gear 19 having a small diameter and capable of meshing with the gear 18 is coaxially integrated with the input shaft 17. The gears 18 and 19 constitute a gear transmission mechanism 20 which reduces rotation power applied to the input shaft 17 and transmits it to the pulley 16.

Other part of the front side of the fixed plate 10 than the arm parts 12, 13 and front side support part 14 is an open part 30 through which the rope is capable of being removably mounted onto the pulley 16 from the front side of the ascender 1. Between the left and right ends of the upper portion of the front side support part 14 and the back part 11 of the fixed plate 10, there are arranged guide plates 31 and 32 which are respectively hung down from the back part 11 to prevent the rope 2 from coming into contact with the input shaft 17 and gear 19. Between the left and right arm parts 12, 13 and the back part 11 of the fixed plate 10, guide rollers 33 and 34 for guiding an intrusion route and an escape route for the rope 2 are rotatably supported at a distance from the guide plates 31, 32. A space between the guide roller 33 and guide plate 31 forms a rope entrance passage 35 which guides the rope 2 from the outside of the ascender 1 to the pulley 16. A space between the guide roller 34 and guide plate 32 forms a rope exit passage 36 which guides the rope 2 from the pulley 16 to the outside of the ascender 1. Between the leading end edge 37 of the arm part 12 and guide plate 31, and between the leading end edge 38 of the arm part 13 and guide plate 23, there are formed clearances S1 and S2 which are respectively capable of removably inserting the rope 2 into the rope entrance passage 35 and rope exist passage 36 from the front surface side of the ascender 1.

A cylindrical support shaft 41 having a carabiner hanging hole 40 is mounted orthogonally from the back surface part 11 into such portion of the lower end of the back part 11 of the fixed plate 10 as exists below the pulley 16 and gear 18. On the front end of the support shaft 41, there is rotatably supported a guard plate 42 serving as a movable closing member for closing/opening the open part 30 existing on the front surface side of the fixed plate 10. The guard plate 42 is formed substantially in a pear-like shape. An upper end of the guard plate 42 when the open part 30 is rotated 180 degrees from the closed state is supported on the support shaft 41 (see FIG. 1). When the guard plate 42 is rotated to a position for closing the open part 30, the front surface of the front side support part 14 comes close to the back surface of the open part 30 (see FIG. 4). The support shaft 15 of the pulley 16 mounts a push button 43 on the front surface side. The leading end of the push button 43 is formed in a cylinder convex shape and is disposed to project forwardly of the front side support part 14 (see FIG. 3). The push button 43 is energized forward by a coil spring (not shown). When a leading end of the push button 43 is pushed in the direction of the back surface of the ascender 1 with a finger, the push button 43 can be pushed to substantially the same height of the front side support part 14, whereas when the finger is released, the push button 43 returns to its original state.

In the vicinity of the center of the guard plate 42, there is formed a semi-elliptical engagement hole 44 which is engaged with the push button 43 when the guard plate 42 is rotated to a position for covering the open part 30. The guard plate 42 also includes a bulging part 45 which, in a state where the guard plate 42 is rotated downward and is thereby opened, is bulged forward from the right end of the engagement hole 44 of the guard plate 42 to the right end edge of the guard plate 42 with its section being formed in a dome-like shape and also which is formed in a partial annular shape as viewed from the front. The bulging part 45 enables the push button 43 to pass from the outside of the guard plate 42 to the engagement hole 44. A laterally facing U-shaped protection member 46 made of hard rubber is arranged to surround the upper side, lower side and left side in FIG. 1 of the engagement hole 44. The protection member 46 reduces the sense of step when pressing the push button 43 which is in the return state, while the section of the protection member 46 is formed in a mountain shape. As shown in FIG. 4, when the guard plate 42 is moved to a position for closing the open part 30, such end edge 47 of the engagement hole 44 as exists on the opposite side to the bulging part 45 is engaged with the push button 43 which is in the pushed state or in the return state, thereby regulating the rotation of the guard plate 42 in the counterclockwise direction in FIG. 4. Also, such end edge 48 of the bulging part 45 as exists on the side of the engagement hole 44 is engaged with the push button 43 which is in the forward return state, thereby regulating the movement of the guard plate 42 in the clockwise direction in FIG. 4.

A cam 50 is rotatably journaled on the support shaft 41. The cam 50 is journaled so as to move toward/away from the pulley 16. Specifically, when the ascender 1 is going to move in the descending direction with respect to the rope 2 (when the pulley 16 is going to move in the clockwise direction of FIG. 1 together with the rope 2), a rope contact part 51 having a substantially arc shape in its plan view and a recessed cross section is rotated in a direction to bite into the rope 2 (in the counterclockwise direction in FIG. 1) to prevent such movement. When the ascender 1 is going to move in the ascending direction with respect to the rope 2 (when the pulley 16 is going to move in the counterclockwise direction of FIG. 1 together with the rope 2), the rope contact part 51 is rotated in a direction to move away from the pulley 16 (in the clockwise direction in FIG. 1), thereby allowing the pulley 16 to move in the counterclockwise direction of FIG. 1 together with the rope 2. The rope contact part 51 includes, on its recessed rope contact surface 51A, a large number of teeth 52 which, when the rope 2 is going to move in the clockwise direction together with the pulley 16, stick to the surface of the rope, thereby preventing such movement of the rope 2 (see FIG. 3). The cam 50 includes, in its inner periphery close to the support shaft 41, a partially annular shaped groove 50A which incorporates therein a tension coil spring 50B serving as an energizing member to normally energize the cam 50 in a direction to move toward the pulley 16 in the counterclockwise direction in FIG. 1. The left end (in FIG. 1) of the tension coil spring 50B is fixed to the support shaft 41, whereas the right end is fixed to the cam 50. In the back part 11 of the fixed plate 10, there is implanted a stopper pin 53 to limit the return-direction movement of the cam 50 energized by the tension coil spring 50B, whereby the leading end of the rope contact part 51 is prevented from rotating in the counterclockwise direction in FIG. 1 further than its contact position with the inside diameter of the pulley 16.

On such back side of the cam 50 as exists close to the leading end of the rope contact part 51, there is mounted an operation member 54 serving as operating member to perform an operation to move the rope contact part 51 away from the pulley 16 and rope 2 in such a manner that it is free to slide to a rail-shaped slide guide part 55 which is formed to extend linearly and substantially orthogonally backward from the rope contact part 51 (see FIG. 5(*a*)). The operation member 54 includes, in its lower part, a recess 54A having a U-shaped section, while the operation member 54 is slidably mounted in such a manner that the recess 54A extends over the slide guide part 55. The slide guide part 55 has a long hole 56, while the operation member 54 can slide linearly back and forth along the slide guide part 55 in a state where a pin 57 implanted in the front end of the operation member 54 is fitted into the long hole 56 (see FIG. 5(*b*)). In the long hole 56 of the slide guide part 55, specifically, between its rear end and the pin 57, there is interposed a compression coil spring 58 (see FIG. 1), thereby normally energizing the operation member 54 toward the leading end of the rope contact part 51. While putting a thumb on a finger rest part 59 formed on the leading end side of the operation member 54, when an operator pushes the operation member 54 in the clockwise direction of FIG. 1 around the support shaft 41, the operator can rotate the cam 50 in a direction to move away from the pulley 16. When the operator pushes the operation member 54 orthogonally backward as viewed from the leading end of the rope contact part 51 along the slide guide part 55, the operator can slide the operation member 54 backward with respect to the cam 50 (obliquely downward in FIG. 1) (see the arrow A in FIG. 5(*b*)).

Figure 6:
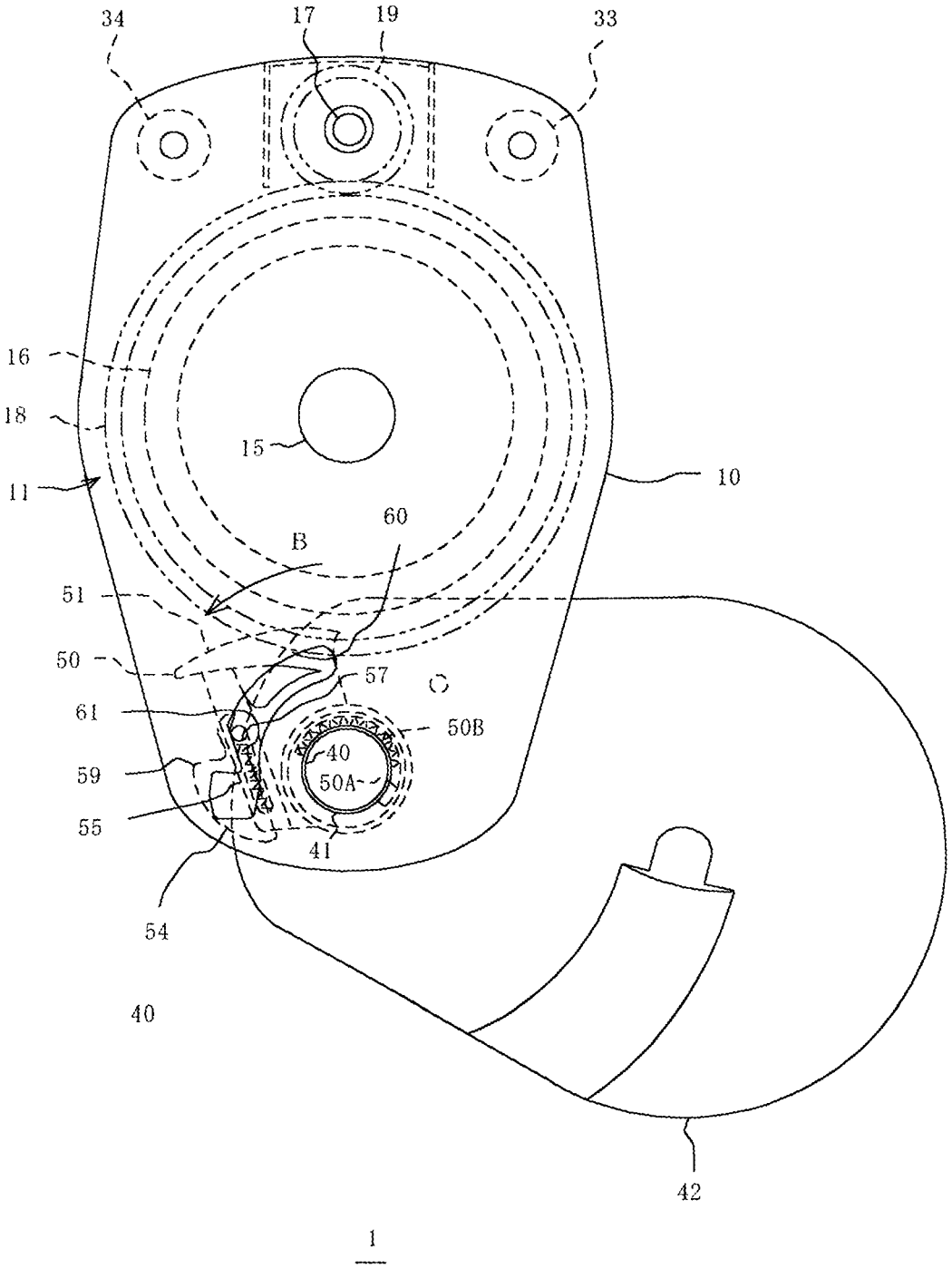
FIG. 6 is an explanatory view of operation of a cam included in the ascender of FIG. 1.
Figure 7:
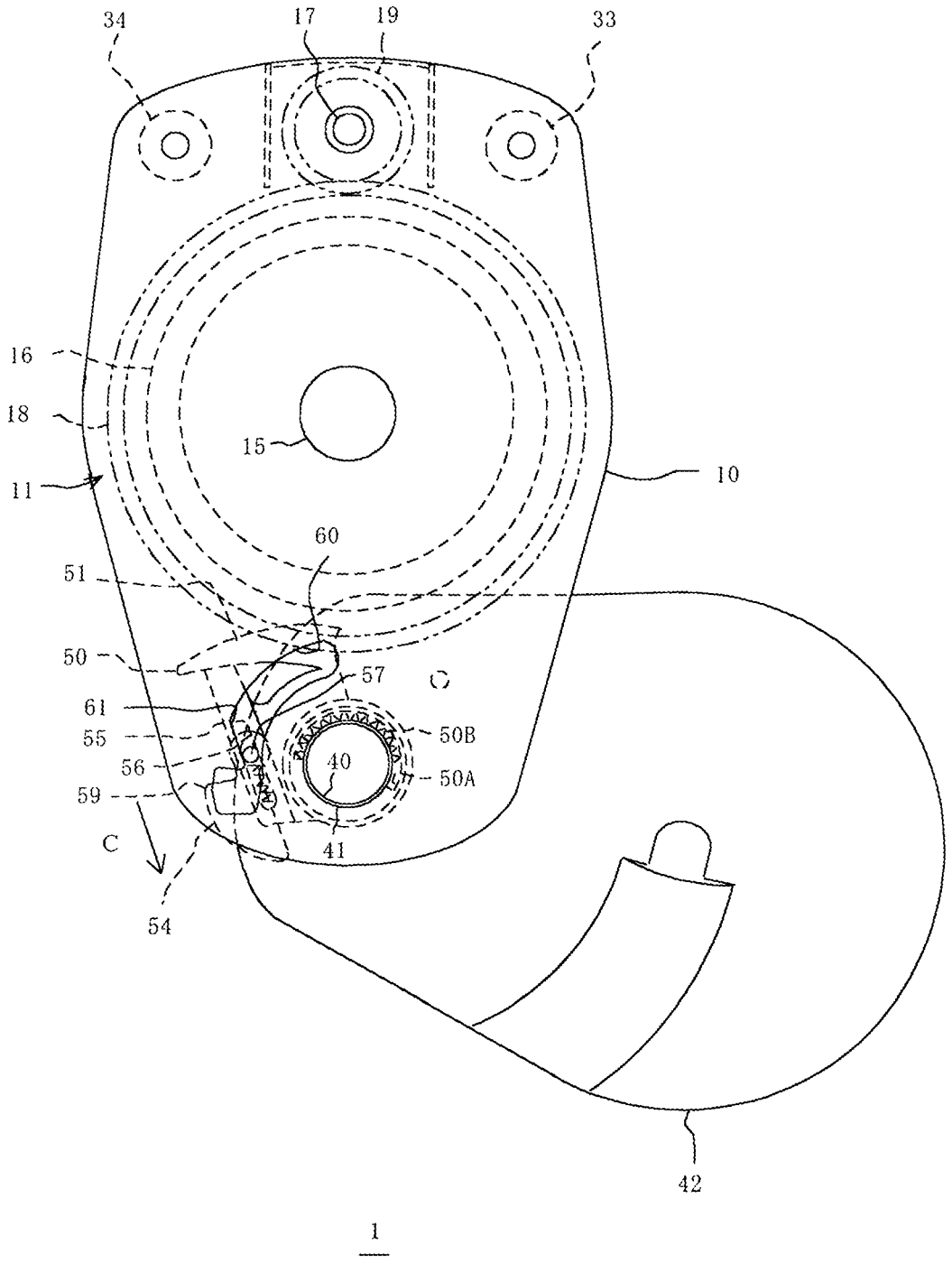
FIG. 7 is an explanatory view of operation of the cam of the ascender of FIG. 1.
Figure 8:
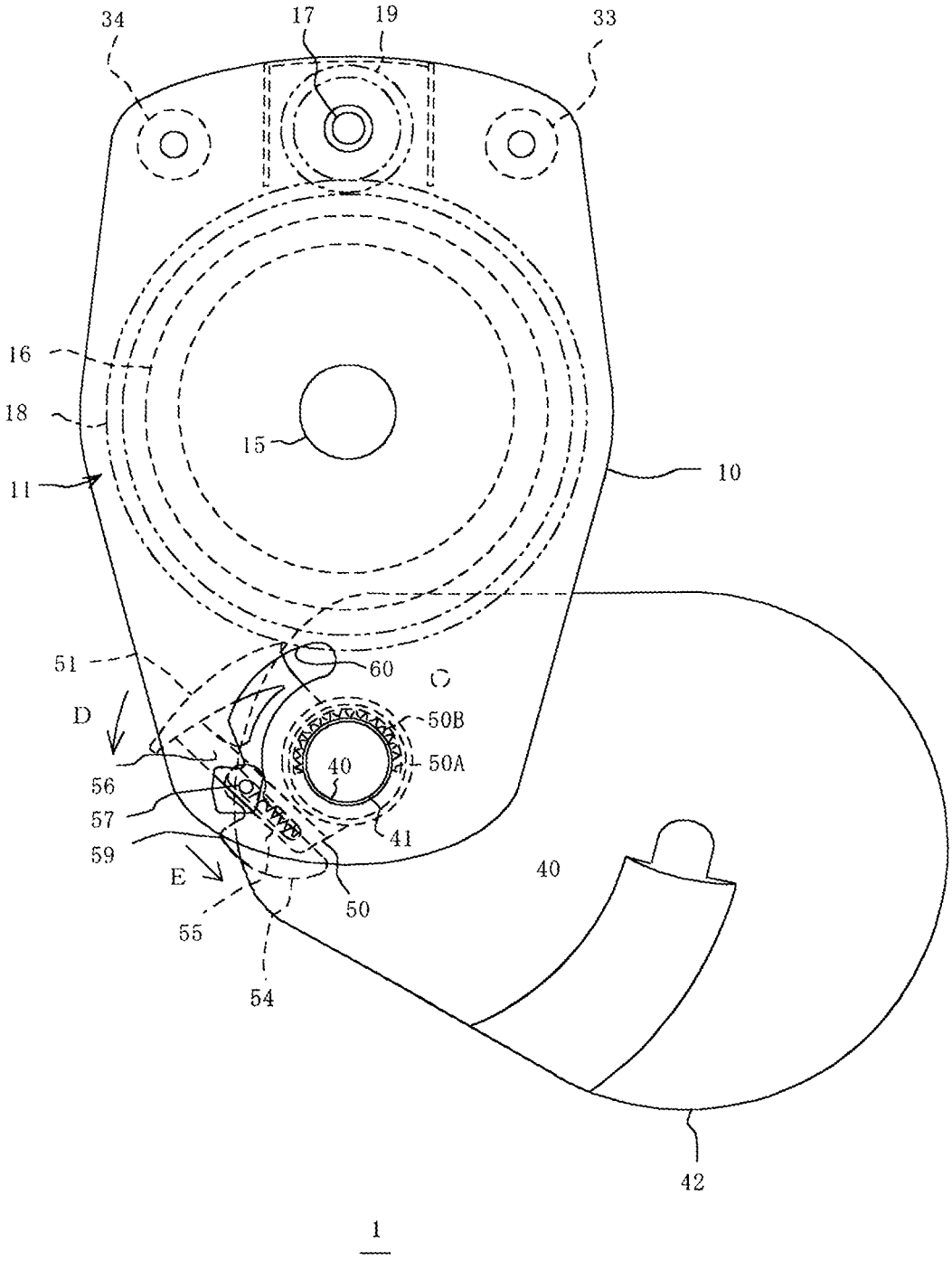
FIG. 8 is an explanatory view of operation of the cam of the ascender of FIG. 1.
Figure 9:
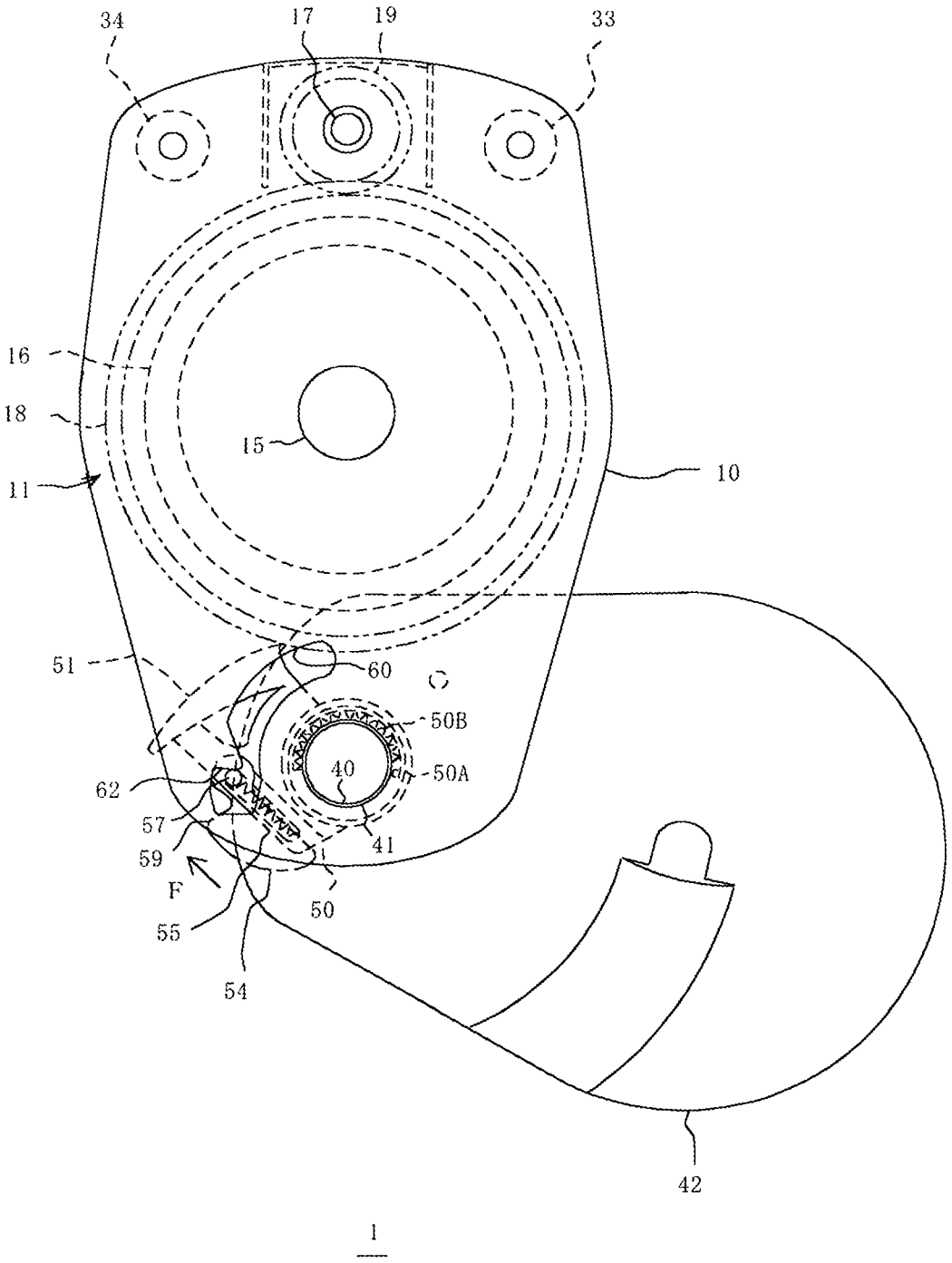
FIG. 9 is an explanatory view of operation of the cam of the ascender of FIG. 1.

The back side end in FIG. 1 of the pin 57 is projected outwardly of the back surface of the fixed plate 10 (see FIG. 3). In the back part 11 of the fixed plate 10, as shown in FIG. 2, there is formed a guide hole 60 which extends in a substantially arc-like shape around the support shaft 41 and through which the pin 57 can be loosely inserted. The guide hole 60 includes: a linear guide part 61 which, when such portion of the operation member 54 as exists close to the leading end of the slide guide part 55 (such portion as exists close to the leading end of the rope contact part 51) is pressed in the clockwise direction of FIG. 1 (in the counterclockwise direction of FIG. 2) around the support shaft 41 to rotate the cam 50 in a direction to move away from the pulley 16, can come into contact with the pin 57 on the way to thereby cause the operation member 54 to slide along the slide guide part 55 orthogonally backward when viewed from the leading end of the rope contact part 51 (see FIGS. 2, 6 and 7); and, a pin locking part 62 which is formed by cutting the guide hole 60 from the rear end of the linear guide part 61 outward about 90 degrees (outward in the radial direction of the support shaft 41) and to which the pin 57 can be locked (see FIG. 8). Therefore, when the portion of the operation member 54 existing close to the leading end of the slide guide part 55 is pushed clockwise around the support shaft 41, the pin 57 can be locked to the pin locking part 62 finally, whereby a large clearance is formed between the rope contact part 51 and pulley 16 and thus the rope 2 can be removably mounted onto the pulley 16 (see FIG. 8). In the locked state, when the operation member 54 is pushed along the slide guide part 55 orthogonally backward as viewed from the leading end of the rope contact part 51, the locked state can be removed (see FIG. 9); and, when the operation member 54 is returned to the front end side of the slide guide part 55 and the finger is released, the cam 50 can be returned in the counterclockwise direction of FIG. 1 by a tension coil spring 50B (see FIG. 10). The slide guide part 55, long hole 56, pin 57, compression coil spring 58, guide hole 60, linear guide part 61 and pin locking part 62 constitute a locking mechanism which locks the cam 50 at a position away from the pulley 16 or unlocks the locked cam.

As shown in FIG. 4, when the guard plate 42 closing the front surface of the ascender 1 is rotated clockwise, the open part 30 is opened to expose the operation member 54, thereby enabling the operator to operate the operation member 54. Also, the pulley 16 is exposed, the rope 2 is wound on the pulley 16 from the front surface side of the ascender 1, and such portions of the rope 2 as extend from both sides of the pulley 6 are inserted through the rope entrance passage 35 and rope exit passage 36, thereby enabling loading of the rope 2.

FIGS. 6 to 13 are respectively explanatory views of a method for using the above-mentioned ascender 1 and, with reference to these figures, the operation of the above embodiment is described below.

Supposing beforehand that, as shown in FIG. 4, the guard plate 42 closes the open part 30 of the fixed plate 10, and the push button 43 projects at a height where it can be engaged with the end edge 47 of the engagement hole 44 and the end edge 48 of the bulging part 45 of the guard plate 42; also, the cam 50 is energized by the tension coil spring 50B and is thereby returned to a position close to the pulley 16, and the operation member 54 is also energized by the compression coil spring 58 and is thereby returned close to the leading end of the rope contact part 51; and further, a rope to be ascended (see reference numeral 2 shown in FIG. 10) hangs down from a support point existing above an operation site.

To ascend the rope 2 using the ascender 1, the push button 43 is pressed and is pushed into the ascender, and the guard plate 42 is rotated in the clockwise direction of FIG. 4 to pass the push button 43 through the back side of the bulging part 45, thereby exposing the open part 30 forward (see FIGS. 1 and 2). The push button 43 is energized by a coil spring (not shown) to return to its original projecting state. Next, a thumb is put on the finger rest part 59 to push it in the clockwise direction of FIG. 1; when the pin 57 comes into contact with the linear guide part 61 of the guide hole 60 (see FIG. 6. Here, FIGS. 6 to 9 are back views), the operation member 54 is pressed in the counterclockwise direction of FIG. 6 and backwardly of the slide guide part 55 (see the arrows B in FIG. 6 and the arrow C in FIG. 7); when the pin 57 has passed through the pin locking part 62 (see the arrows D and E in FIG. 8), the pin 57 is moved forwardly of the slide guide part 55 while keeping on its pressing in the counterclockwise direction of FIG. 8; and, when the pin 57 comes into contact with the pin locking part 62, the thumb is released. Since the operation member 54 is energized forwardly of the slide guide part 55 by the compression coil spring 58, the pin 57 is locked to the pin locking part 62 and the rope contact part 51 of the cam 50 is separated from the pulley 16 (see the arrow F in FIG. 9).

Next, the rope 2 is wound on the pulley 16 from the front side of the open part 30 of the ascender 1, the upper side 2*a* of the rope 2 existing close to the support point is inserted into the rope entrance passage 35 between the guide plate 31 and guide roller 33, and the lower side 2*b* of the rope 2 existing distant from the support point is inserted into the rope exist passage 36 between the guide plate 32 and guide roller 34. After then, the thumb is put on the finger rest part 59 of the operation member 54 to press it backwardly of the slide guide part 55, thereby unlocking the pin 57 from the pin locking part 62; and further, while rotating the operation member 54 in the clockwise direction of FIG. 9, the thumb is released. The cam 50 is energized by the tension coil spring 50B to return in the clockwise direction of FIG. 9, and the rope contact part 51 comes into contact with the rope 2. The operation member 54 is energized by the compression coil spring 58 to return to the vicinity of the leading end of the slide guide part 55 (see FIG. 10. Here, FIGS. 10 to 13 are views of the ascender 1 when viewed from its front side).

Figure 11:
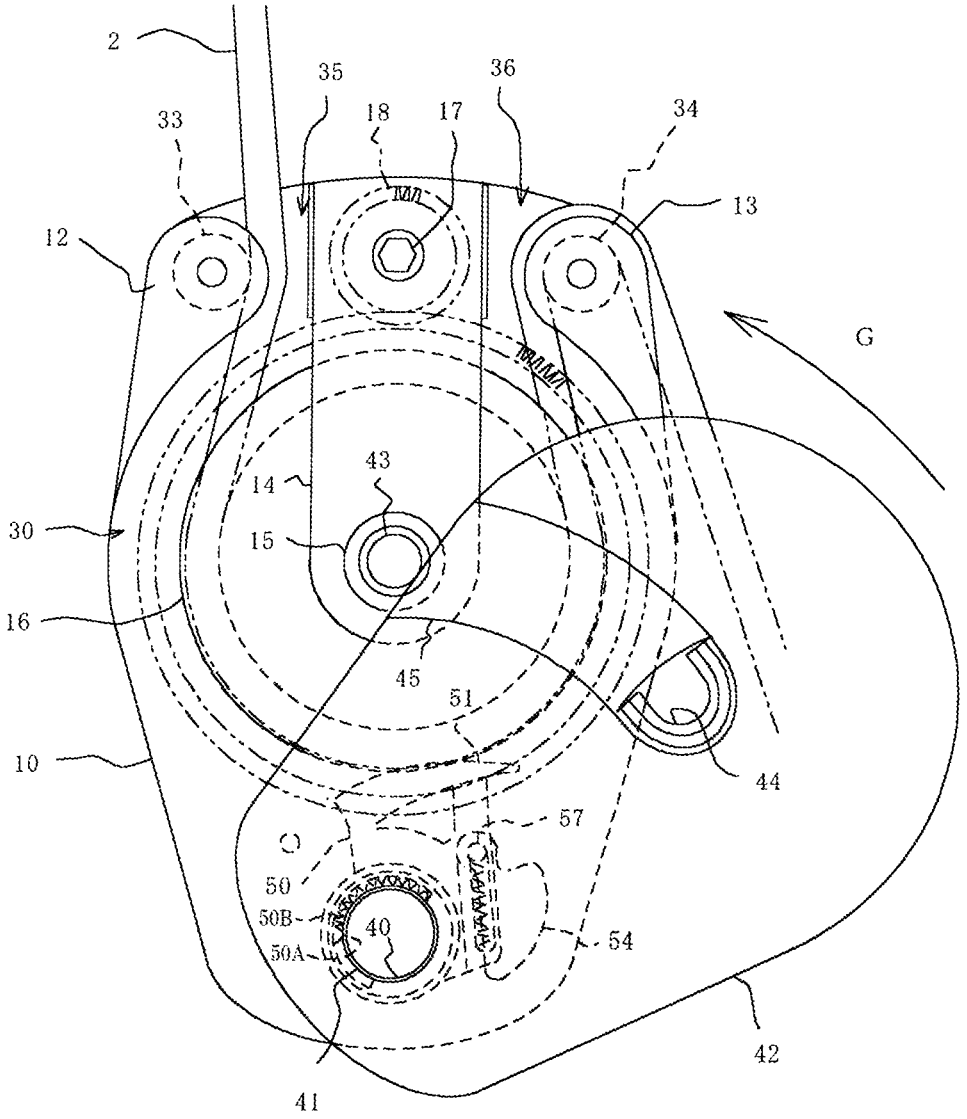
FIG. 11 is an explanatory view of the method for using the ascender of FIG. 1.
Figure 12:
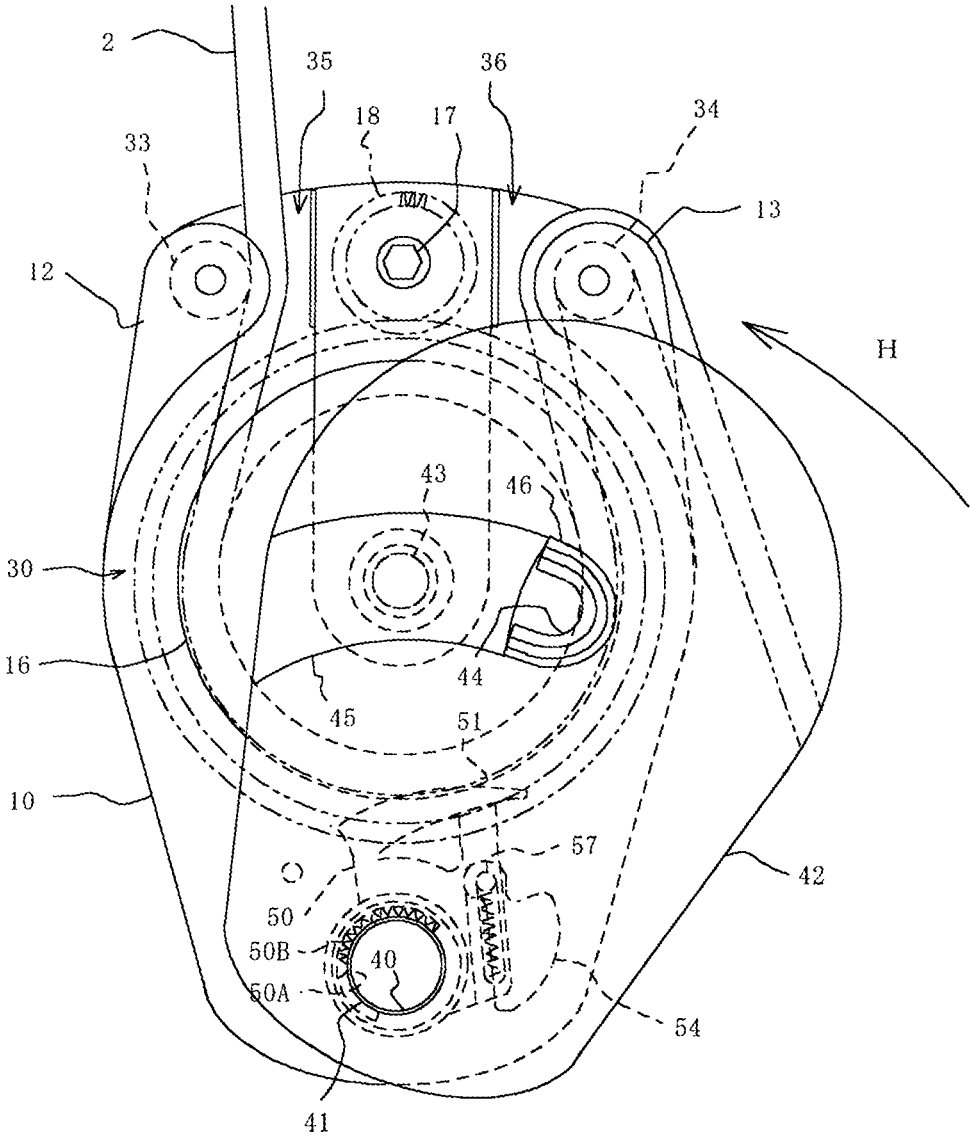
FIG. 12 is an explanatory view of the method for using the ascender of FIG. 1.

Next, the guard plate 42 is rotated in the counterclockwise direction of FIG. 11 to move the push button 43 from one end side of the bulging part 45 to its back side (see the arrow G of FIG. 11 and the arrow H of FIG. 12), and, on the way, while pushing in the push button 43 slightly, the push button 43 is exposed from the other end side end edge 48 to the engagement hole 44. The push button 43 returns to its original return state, and the guard plate 42 is fixed to a position for closing the open part 30 (see FIG. 13).

Finally, a carabiner existing on one end side of a carabiner-equipped rope sling (not shown) is hung in the hole 40 for carabiner hanging, and a carabiner on the other end side of the carabiner-equipped rope sling is hung in a harness worn by the operator, thereby ending preparation. When the operator puts his or her weight on the ascender 1 through the carabiner-equipped rope sling, tension is applied to the upper side 2*a* of the rope 2 to cause the pulley 16 to generate a rotation force in the clockwise direction of FIG. 13. In this case, in the cam 50, there is generated a rotation force in a direction to approach the pulley, whereby the rope contact part 51 bites into the rope 2 to press it and also the teeth 52 stick to the surface of the rope to restrain the rotation of the pulley 16. This prevents the ascender 1 from descending relative to the rope 2.

Figure 13:
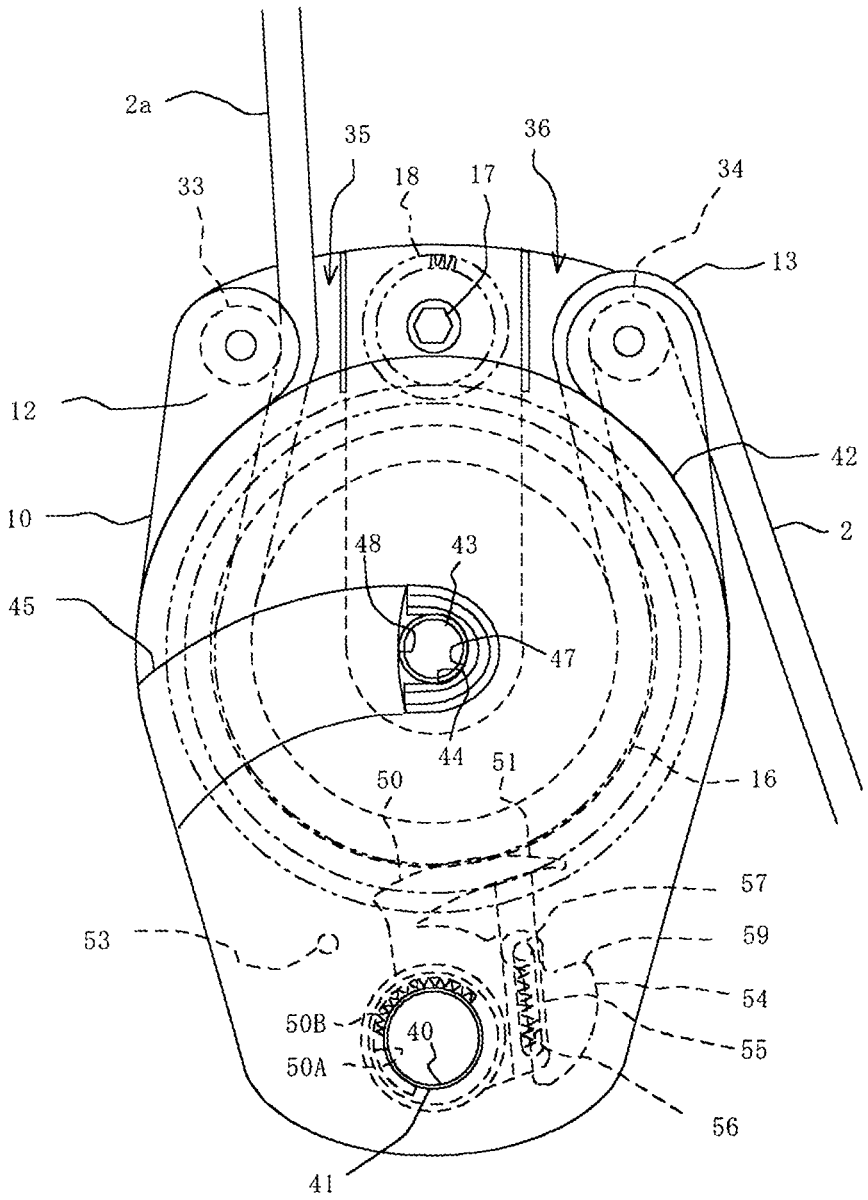
FIG. 13 is an explanatory view of the method for using the ascender of FIG. 1.

To start ascent, the operator fits the input shaft 17 to the chuck part 4 serving as the output shaft of the electric screwdriver 3 carried by the operator to fasten it (see FIG. 3), and rotates the electric screwdriver 3 in the clockwise direction of FIG. 13. Accordingly, the rotational force of the electric screwdriver 3 is decelerated by the gear transmission mechanism 20 and the pulley 16 rotates in the counterclockwise direction of FIG. 13 to thereby move the rope 2 counterclockwise along the peripheral direction of the pulley 16. In this case, since the cam 50 receives a force in a direction to move away from the pulley 16, the pulley 16 is not constrained to rotate but moves the rope 2 counterclockwise (in the ascending direction) continuously, thereby enabling the operator to ascend the rope 2. When the operator stops the electric screwdriver 3 at a desired height, the ascent of the rope 2 can be stopped. In this case, although the weight of the operator applies tension to the upper side 2*a* of the rope 2 to thereby generate in the pulley a rotation force in the clockwise direction, the rope contact part 51 of the cam 50 presses the rope 2 to restrict the rotation of the pulley 16, thereby preventing the ascender 1 from descending with respect to the rope 2.

According to the embodiment, since an ascending with the rope 2 is possible by using the electric screwdriver 3 as its drive source, the burden of the labor of the operator for ascent can be reduced greatly. And, the electric screwdriver 3 is an ordinary tool to be carried for various operations, thereby eliminating a burden to prepare or carry a special drive source. Also, the electric screwdriver 3 is rechargeable, thereby eliminating troublesome power cord routing.

Here, in the above embodiment, as an example of an electric tool, there is taken an electric screwdriver. However, the invention is not limited to this at all but other rotary electric tools such as electric drills may also be used. Also, a non-rechargeable electric tool may also be used.

Also, the operation member is configured such that it is free to slide along the slide guide part, but it may also be configured such that it is fixed to the cam.

Further, there may be previously formed in the input shaft a hexagon bit hole capable of removably connecting a hexagon bit thereto, and, using a rotary electric tool with a hexagon bit, the hexagon bit may be connected to the input shaft as the output shaft of the rotary electric tool to rotate the input shaft.

Moreover, although the rotational force applied to the input shaft is transmitted to the pulley by the gear transmission mechanism constituted of the two large and small gears, the rotational force may also be transmitted by a planetary gear mechanism.

The present application is based on the Japanese Patent Application No. 2016-46372 filed on May 9, 2016 and thus the contents thereof are incorporated herein by reference.

INDUSTRIAL APPLICABILITY

The invention can be applied to an ascender which enables an operator carrying a rotary electric tool to ascend using a rope.

DESCRIPTION OF REFERENCE NUMERALS AND SIGNS

1: Ascender
10: Fixed plate
16: Pulley
17: Input shaft
18, 19: Gear
30: Open part
31, 32: Guide plate
33, 34: Guide roller

35: Rope entrance passage
36: Rope exit passage
40: Hole
41: Support shaft
42: Guard plate
50: Cam
50B: Tension coil spring
51: Rope contact part
52: Teeth
54: Operation member
55: Slide guide part
58: Compression coil spring
60: Guide hole

The invention claimed is:

1. An ascender comprising:

a pulley having a circular shape and capable of removably winding a rope thereon;

an input shaft capable of removably connecting an output shaft of a rotary electric tool thereto;

a support member having a fixed plate integrally connected with a front side support part, the support member supporting the pulley and the input shaft to be rotatable and including an open part which enables the rope to be wound on the pulley;

a transmission mechanism interposed between the input shaft and the pulley so as to transmit a rotational force of the input shaft to the pulley;

a rope guide provided on the support member so as to guide the rope wound on the pulley at an entrance passage and an exit passage of the rope;

a cam pivotally supported on the support member so as to be movable toward and away from the pulley, the cam being configured to move toward the pulley to bite into the rope wound on the pulley to thereby prevent a movement of the ascender with respect to the rope when the ascender is going to move in a descending direction, and to move away from the pulley to allow the movement of the ascender with respect to the rope when the ascender is going to move in an ascending direction;

an energizing member that energizes the cam in a direction to move toward the pulley;

an operating member for an action to move the cam away from the pulley; and a closing member that is movable for opening and closing the open part, the closing member being pivotally supported on a support shaft mounted on the support member, the support shaft including a carabiner hanging hole, wherein the pulley is capable of being rotated more than a full revolution.

2. The ascender according to claim 1, further comprising:

a large number of teeth formed on a rope contact surface of the cam and configured to bite into the rope when the ascender is going to move in the descending direction.

3. The ascender according to claim 1, further comprising:

a locking and unlocking device configured to lock the cam to a position spaced from the pulley and to unlock the locked cam.

4. The ascender according to claim 1, wherein the rotary electric tool is rechargeable.

* * * * *